US006209994B1

(12) United States Patent
Furuhata et al.

(10) Patent No.: US 6,209,994 B1
(45) Date of Patent: Apr. 3, 2001

(54) MICRO DEVICE, INK-JET PRINTING HEAD, METHOD OF MANUFACTURING THEM AND INK-JET RECORDING DEVICE

(75) Inventors: Yutaka Furuhata; Yoshinao Miyata; Hajime Mizutani, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/153,034

(22) Filed: Sep. 15, 1998

(30) Foreign Application Priority Data

Sep. 17, 1997 (JP) ..... 9-252213
Nov. 10, 1997 (JP) ..... 9-307436

(51) Int. Cl.[7] ..... B41J 2/045

(52) U.S. Cl. ..... 347/68; 347/71; 347/70; 310/330; 310/331

(58) Field of Search ..... 347/68, 70, 71; 310/330, 331

(56) References Cited

U.S. PATENT DOCUMENTS 5,366,454 11/1994 Currie et al. ..... 604/890.1
5,446,484 8/1995 Hoisington et al. ..... 347/68
5,632,841 5/1997 Hellbaum et al. ..... 156/245
5,852,337 * 12/1998 Takeuchi et al. ..... 30/331

FOREIGN PATENT DOCUMENTS 5-286131 11/1993 (JP) ..... B41J/2/045

OTHER PUBLICATIONS

Patent Abstracts of Japan, vol. 018, No. 065 (M–1554), Nov. 2, 1993.
Patent Abstracts of Japan, vol. 1996, No. 05, Jan. 9, 1996.
Patent Abstracts of Japan, vol. 017, No. 286 (M–1422), Jan. 26, 1997.

* cited by examiner

*Primary Examiner*—David F. Yockey
*Assistant Examiner*—Charles W. Stewart
(74) *Attorney, Agent, or Firm*—Sughrue, Mion, Zinn, Macpeak & Seas, PLLC

(57) ABSTRACT

In a micro device including a through hole for piercing a substrate and a fragile part provided around or across a part corresponding to a through hole of a multilayer film and relatively thinner than the other part, an opening can be formed in the multilayer film by cutting the multilayer film along or inside the fragile part and a through hole can be formed.

26 Claims, 12 Drawing Sheets

MICRO DEVICE, INK-JET PRINTING HEAD, METHOD OF MANUFACTURING THEM AND INK-JET RECORDING DEVICE

BACKGROUND OF THE INVENTION

1. Field of the Invention

The present invention relates to a micro device and a method of manufacturing the same. More particularly, the invention relates to a method of manufacturing an ink-jet printing head wherein a part of a pressure generating chamber communicating with a nozzle aperture for ejecting ink droplets is composed of a diaphragm, a piezoelectric element is provided via the diaphragm and an ink droplet is ejected by the displacement of the piezoelectric element, the ink-jet printing head and an ink-jet printing device.

2. Related Art

Heretofore, there is an ink-jet printing head so manufactured as one type of a micro device including such an ink-jet printing head provided with an active plate and an active plate actuator for driving the active plate on one side of a substrate.

There has been known two different types of such an ink-jet printing head in which a part of a pressure generating chamber communicating with a nozzle aperture for ejecting ink droplets is composed of a diaphragm, an ink droplet is ejected from a nozzle aperture by deforming the diaphragm by a piezoelectric element and pressurizing ink in the pressure generating chamber. One type employs a piezoelectric actuator in a longitudinal vibration mode in which the piezoelectric element expands and contracts in an axial direction, whereas the other type includes a piezoelectric actuator in a flexural vibration mode.

For the former type, the volume of a pressure generating chamber can vary by contacting an end face of the piezoelectric element to a diaphragm and a head suitable for high density printing can be manufactured. However, this type requires a difficult process for cutting into piezoelectric elements according to the arrangement pitch of nozzle apertures like the teeth of a comb and work for positioning and fixing the cut piezoelectric element on a pressure generating chamber. Thus, this type of the printing head requires a complicated manufacturing process.

In the meantime, for the latter type, a piezoelectric element can be attached onto a diaphragm in a relatively simple process for sticking and burning a green sheet serving as a piezoelectric material so that the shape is in the shape of a pressure generating chamber. However, a certain area is required because flexural vibration is utilized and, hence, there would it is difficult to form high density arrangement.

To solve the problems of the printing head equivalent to the latter type, a printing head wherein a uniform piezoelectric material layer is formed overall on the surface of a diaphragm using film forming technique, the piezoelectric material layer is cut into a shape corresponding to a pressure generating chamber by lithography and a piezoelectric element is independently formed for every pressure generating chamber is proposed as disclosed in Unexamined Japanese Patent Publication No. Hei. 5-286131.

Hereby, there are advantages for not demanding work for sticking a piezoelectric element on a diaphragm and a piezoelectric element can be fixed by a precise, simple method of lithography. In addition, a piezoelectric element can be thinned that enables high speed driving.

In this case, a monocrystalline silicon substrate, for example, can be used for a substrate, a pressure generating chamber and a passage such as a reservoir can be formed by anisotropic etching and recording density can be enhanced by reducing the area of the opening of a pressure generating chamber as much as possible.

When the above monocrystalline silicon substrate is anisotropically etched, parts to be through holes such as a reference hole for positioning, an ink inlet and a separating hole every are formed simultaneously with pressure generating chambers. At this time, generally, after the monocrystalline silicon substrate, except a silicon dioxide film which is the lowest layer, is etched, a part of a film corresponding to a through hole is etched or removed physically. However, there is a problem that when the films are removed, surroundings of the through hole are overetched or films around the through hole are peeled. If only the silicon dioxide film is left, there is a problem that etching gas or etchant invades on the reverse side due to the defect of the film. Further, particularly if a part of the films corresponding to a through hole are physically removed by inserting a reference pin and others, there is a problem that a film is freed, invades between the reference pin and the through hole and the failure of alignment is caused.

Such problems are caused not only in an ink-jet printing head but in a micro device such as a micro sensor provided with an active plate and an active plate actuator on one side of a substrate.

SUMMARY OF THE INVENTION

In view of the difficulties and problems accompanying the conventional ink-jet printing head, it is an object of the present invention to provide a method of manufacturing a micro device in which a through part can be efficiently and securely formed and such a micro device, particularly a method of manufacturing an ink-jet printing head, such an ink-jet printing head and an ink-jet recording device including such an ink-jet printing head.

A first aspect of the present invention to solve the above problems relates to a micro device based upon a micro device provided with multilayer structure constituting an active plate for performing predetermined action and an active plate actuator for driving the active plate on one side of a substrate and characterized in that a through hole which pierces the above substrate and a fragile part provided around or across a part corresponding to a through hole of a multilayer film and relatively thinner than the other part are provided.

According to such a first aspect, the above multilayer film can be readily cut via the fragile part, the above through hole can be simply formed, a thin film is prevented from being scattered when the through hole is formed, and a reference pin and others can be securely fitted to the through hole.

A second aspect of the present invention relates to a micro device based upon the first embodiment and characterized in that the above multilayer film covering the above part corresponding to a through hole is provided with a film provided with tensile in-plane stress at least on the upper layer and the in-plane stress of the whole multilayer film is directed in the direction of a tensile load, and the above fragile part is provided around or across the part corresponding to a through hole of the multilayer film and includes a fragile cut part relatively lower in fragility than the other part.

According to such a second aspect, when the through hole is formed, the multilayer film is lifted along the edge, and the reference pin and the through hole can be securely touched.

A third aspect of the present invention relates to a micro device based upon the second aspect and characterized in that the above fragile cut part is linearly formed.

According to such a third aspect, the multilayer film is readily cut linearly and a through hole can be further simply formed inside a passage forming substrate.

A fourth aspect of the present invention relates to a micro device based upon the second or third aspect and characterized in that the above fragile cut part is a notched groove formed at least on one layer of the above multilayer film.

According to such a fourth aspect, the multilayer film is readily cut along the notched groove and a through hole can be simply formed inside a passage forming substrate.

A fifth aspect of the present invention relates to a micro device based upon any of the second to fourth aspects and characterized in that the above multilayer film includes a silicon oxide film provided with compressive stress and a metallic film formed on the silicon oxide film and provided with tensile stress.

According to such a fifth aspect, tensile stress is caused by the stress of the silicon oxide film and the stress of the metallic film as a whole in the multilayer film and a through hole can be simply inside a passage forming substrate.

A sixth aspect of the present invention relates to a micro device based upon the fifth aspect and characterized in that the above multilayer film further includes an insulating layer provided with tensile stress as the uppermost layer.

According to such a sixth aspect, the tensile stress of the whole multilayer film is enhanced and when a through hole is formed, the multilayer film is securely lifted and the through hole can be further simply formed inside a passage forming substrate.

A seventh aspect of the present invention relates to a micro device based upon the fifth or sixth aspect and characterized in that the above fragile cut part is a notched groove formed at least in a part at least with the thickness of the metallic film of the above multilayer film.

According to such a seventh aspect, the multilayer film is readily cut by the notched groove of the metallic film and a through hole can be further simply formed inside a passage forming substrate.

An eighth aspect of the present invention relates to a micro device based upon any of the first to sixth aspects and characterized in that the above fragile part includes the above part corresponding to a through hole and includes a linear thin film part thinner as a whole than the surroundings of the above multilayer film.

According to such an eighth aspect, the multilayer film can be prevented from being peeled outside the thin film part.

A ninth aspect of the present invention relates to a micro device based upon the eighth aspect and characterized in that a thick film part relatively thicker than the above thin film part is further provided inside the thin film part.

According to such a ninth aspect, the thick film part left when a cap covering a through hole is removed exists inside the thin film part.

A tenth aspect of the present invention relates to an ink-jet printing head based upon any of the first to ninth aspects and characterized in that the above substrate is provided with a row of pressure generating chambers each of which communicates with a nozzle aperture on the other side of the substrate and is partitioned by plural partition walls, and the above substrate is a passage forming substrate provided on one side of the substrate with a piezoelectric element at least including a lower electrode, a piezoelectric layer and an upper electrode layer and formed in an area opposite to the above pressure generating chamber via an elastic film constituting a part of the pressure generating chamber.

According to such a tenth aspect, an ink-jet printing head wherein a through hole can be simply formed inside a passage forming substrate is realized.

An eleventh aspect of the present invention relates to an ink-jet printing head based upon the tenth aspect and characterized in that the above thin film part is composed of at least an elastic film and the above thick film part is composed of at least one of the above elastic film, the above lower electrode, the above piezoelectric layer and the above upper electrode.

According to such an eleventh aspect, when a part in which a film is removed around a through hole is formed, effect upon the thick film part is avoided by the thin film part composed of an elastic film.

A twelfth aspect of the present invention relates to an ink-jet printing head based upon the eleventh aspect and characterized in that at least a part in the direction of the thickness of the above elastic film of the above thin film part is removed.

According to such a twelfth aspect, when a part in which a film is removed is formed around a through hole, effect upon the thick film part is avoided by a thin elastic film or the above part in which an elastic film is completely removed.

A thirteenth aspect of the present invention relates to an ink-jet recording device characterized in that the above recording device is provided with the ink-jet printing head according to any of the tenth to twelfth aspects.

According to such a thirteenth aspect, the head can be securely and simply manufactured and the ink-jet recording device is readily manufactured.

A fourteenth aspect of the present invention relates to a method of manufacturing a micro device based upon a method of manufacturing a micro device provided with multilayer structure constituting an active plate for performing predetermined action and an active plate actuator for driving the active plate on one side of a substrate and characterized in that a step forming a fragile part relatively thinner than the other part of a multilayer film around or across a part corresponding to a through hole which pierces the substrate in the multilayer film, a step for forming a through part which pierces the multilayer film by etching the part corresponding to a through hole from the other side of the substrate and a step for forming the above through hole along or inside the fragile part by cutting the multilayer film and forming an opening in the multilayer film after the through part is formed are provided.

According to such a fourteenth aspect, the through hole can be simply formed, a thin film is prevented from being scattered when the through part is formed and a reference pin and others can be securely fitted to the through hole.

A fifteenth aspect of the present invention relates to a method of manufacturing a micro device based upon the fourteenth aspect and characterized in that a step for providing a film provided with tensile in-plane stress at least as an upper layer of a multilayer film covering a part corresponding to a through hole which pierces the above substrate so that the in-plane stress of the whole multilayer film is tensile stress is provided before the above through hole is formed, and an opening is formed in the multilayer film utilizing tensile in-plane stress after the through part is formed to form the through hole.

According to such a fifteenth aspect, the multilayer film is lifted along the edge, and a reference pin and the through hole can be securely touched.

A sixteenth aspect of the present invention relates to a method of manufacturing a micro device based upon the fifteenth aspect and characterized in that the above fragile part includes a fragile cut part along the edge of the part corresponding to a through hole of the above multilayer film and relatively lower in fragility than the other part.

According to such a sixteenth aspect, the multilayer film is lifted along the edge when the through hole is formed, and a reference pin and the through hole can be securely touched.

A seventeenth aspect of the present invention relates to a method of manufacturing a micro device based upon the fifteenth or sixteenth aspect and characterized in that the above fragile part is provided across the part corresponding to a through hole of the above multilayer film and includes a fragile cut part relatively lower in fragility than the other part.

According to such a seventeenth aspect, the multilayer film is cut in the center of the through hole, is securely lifted along the edge, and a reference pin and the through hole can be securely touched.

An eighteenth aspect of the present invention relates to a method of manufacturing a micro device based upon the sixteenth or seventeenth aspect and characterized in that the above fragile cut part is formed linearly.

According to such an eighteenth aspect, the multilayer film is cut along the linear fragile part and a through hole can be further simply formed.

A nineteenth aspect of the present invention relates to a method of manufacturing a micro device based upon any of the fifteenth to eighteenth aspects and characterized in that the above fragile cut part is a notched groove formed at least in one layer of the above multilayer film.

According to such a nineteenth aspect, the multilayer film is readily cut along the notched groove and a through hole can be simply formed.

A twentieth aspect of the present invention relates to a method of manufacturing a micro device based upon any of the fifteenth to nineteenth aspects and characterized in that the above multilayer film includes a silicon oxide film provided with compressive stress and a metallic film formed on the silicon oxide film and provided with tensile stress.

According to such a twentieth aspect, tensile stress is caused by the stress of the silicon oxide film and the stress of the metallic film in the multilayer film as a whole and a through hole can be simply formed.

A twenty-first aspect of the present invention relates to a method of manufacturing a micro device based upon the twentieth aspect and characterized in that the above multilayer film is further provided with an insulating layer provided with tensile stress as an upper layer.

According to such a twenty-first aspect, the tensile stress of the whole multilayer film is enhanced, the multilayer film is securely lifted and a through hole can be further simply formed.

A twenty-second aspect of the present invention relates to a method of manufacturing a micro device based upon the twentieth or twenty-first aspect and characterized in that the above fragile cut part is a notched groove formed at least in a part at least with the thickness of the metallic film of the above multilayer film.

According to such a twenty-second aspect, the multilayer film is readily cut with a notched groove composed of a platinum film.

A twenty-third aspect of the present invention relates to a method of manufacturing a micro device based upon any of the fourteenth to twenty-second aspects and characterized in that the above opening is formed by pressing the multilayer film in the above part corresponding to a through hole.

According to such a twenty-third aspect, the multilayer film is lifted along the fragile part by forming the opening by pressing and a through hole in a predetermined shape can be obtained.

A twenty-fourth aspect of the present invention relates to a method of manufacturing a micro device based upon the twenty-third aspect and characterized in that the multilayer film is pressed from the side of the above through part.

According to such a twenty-fourth aspect, the multilayer film is lifted outside the through hole by pressing the multilayer film from the side of the through part and a through hole can be securely formed.

A twenty-fifth aspect of the present invention relates to a method of manufacturing a micro device based upon the twenty-third or second aspect and characterized in that a crack is made at least in a part of the above fragile cut part before pressing.

According to such a twenty-fifth aspect, as a result of making the crack in a part of the fragile part, a through hole can be readily formed.

A twenty-sixth aspect of the present invention relates to a method of manufacturing a micro device based upon any of the fourteenth to twenty-fifth aspects and characterized in that the above fragile part surrounds the above part corresponding to a through hole and includes a linear thin film part thinner as a whole than the surroundings of the above multilayer film.

According to such a twenty-sixth aspect, the multilayer film outside the thin film part is never peeled.

A twenty-seventh aspect of the present invention relates to a method of manufacturing a micro device based upon the twenty-sixth aspect and characterized in that a step for forming the above fragile part includes a step for forming the above thin film part and a cap thicker as a whole than the thin film part and covering the above part corresponding to a through hole and after the through part is formed, the through hole is formed by removing the above cap.

According to such a twenty-seventh aspect, the above cap prevents etchant from leaking in etching a through hole and as the thin film part exists around the through hole when the cap is removed after etching, the cap can be simply and securely removed.

A twenty-eighth aspect of the present invention relates to a method of manufacturing a micro device based upon the twenty-seventh aspect and characterized in that at least the edge of the above thin film part surrounds the part corresponding to a through hole.

According to such a twenty-eighth aspect, as at least the edge of the thin film part surrounds the part corresponding to a through hole, the inner edge of the thin film part may be also located in a position opposite to the through hole.

A twenty-ninth aspect of the present invention relates to a method of manufacturing a micro device based upon the twenty-seventh or twenty-eighth aspect and characterized in that the above cap is physically removed, attracting it.

According to such a twenty-ninth aspect, when the cap is physically removed after etching,. dust and others are removed by attraction.

A thirtieth aspect of the present invention relates to a method of manufacturing a micro device based upon any of the twenty-seventh to twenty-ninth aspects and characterized in that the above cap is removed by mechanical working or working by a laser beam.

According to such a thirtieth aspect, the cap is simply removed using a needle and others or by radiating a laser beam after etching and at that time, a bad effect upon films around the thin film part is prevented by the thin film part.

A thirty-first aspect of the present invention relates to a method of manufacturing a micro device based upon any of the twenty-eighth to thirtieth aspects and characterized in that the above cap is removed by etching.

According to such a thirty-first aspect, the cap is securely removed by etching after etching and at that time, effect upon the surrounding films by overetching is prevented by the thin film part.

A thirty-second aspect of the present invention relates to a method of manufacturing a micro device based upon any of the fourteenth to thirty-first aspects and characterized in that the above substrate is a monocrystalline silicon substrate and the above multilayer structure is formed by forming films and lithography.

According to such a thirty-second aspect, a through hole can be formed by anisotropically etching the monocrystalline silicon substrate, and etching, work for forming an opening and others at that time can be simply and securely performed.

A thirty-third aspect of the present invention relates to a method of manufacturing an ink-jet printing head based upon any of the fourteenth to thirty-second aspects and characterized in that a nozzle aperture is formed on the other side of the above substrate, is provided with a row of pressure generating chambers each of which is partitioned by plural partition walls and is a passage forming substrate provided on one side with a piezoelectric element at least including a lower electrode, a piezoelectric layer and an upper electrode in an area opposite to each pressure generating chamber via an elastic film constituting a part of the pressure generating chamber.

According to such a thirty-third aspect, a through hole such as a reference hole formed in the passage forming substrate of the ink-jet printing head can be securely and simply formed.

A thirty-fourth aspect of the present invention relates to a method of manufacturing an ink-jet printing head based upon the thirty-third aspect and characterized in that the above cap is composed of at least one of the above elastic film, the above lower electrode, the above piezoelectric layer and the above upper electrode and the above thin film part is composed of at least the elastic film.

According to such a thirty-fourth aspect, leakage in etching is securely prevented by the elastic film and the other films and work for an opening can be simply and securely performed.

A thirty-fifth aspect of the present invention relates to as method of manufacturing an ink-jet printing head based upon the thirty-third aspect and characterized in that the above cap is composed of the above elastic film and the above thin film part is composed an elastic film or a film removed part relatively thinner than the above elastic film.

According to such a thirty-fifth aspect, as the thin film part is very thin or there is no thin film part, the film can be very simply and securely removed after etching.

BRIEF DESCRIPTION OF THE INVENTION

DETAILED DESCRIPTION OF THE PREFERRED EMBODIMENTS

Preferred embodiments of the present invention will now be described in detail hereinbelow with reference to accompanying drawings.

1. First Embodiment

Figure 1:
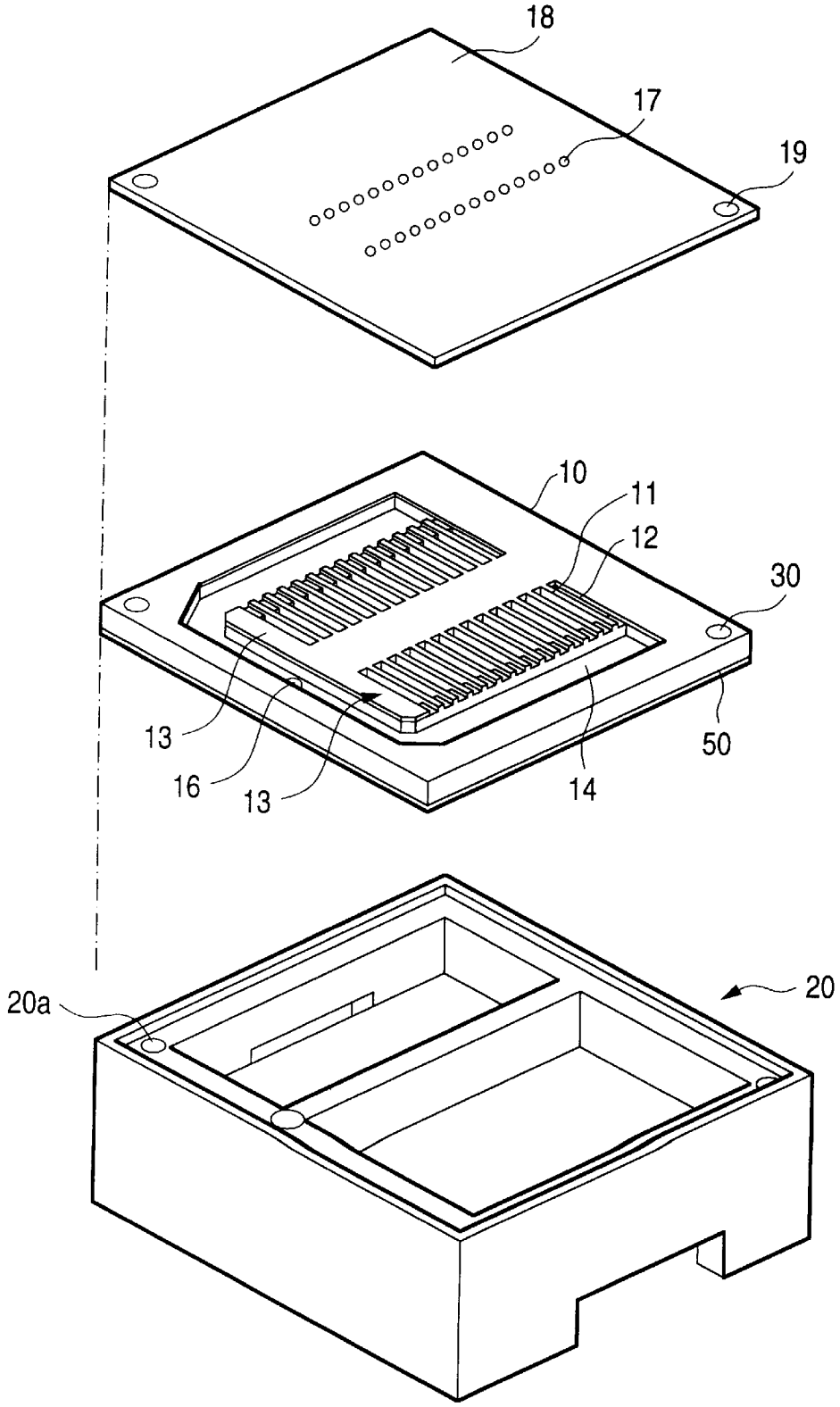
FIG. 1 is an exploded perspective view showing an ink-jet printing head according to an embodiment of the present invention.
Figure 2A:
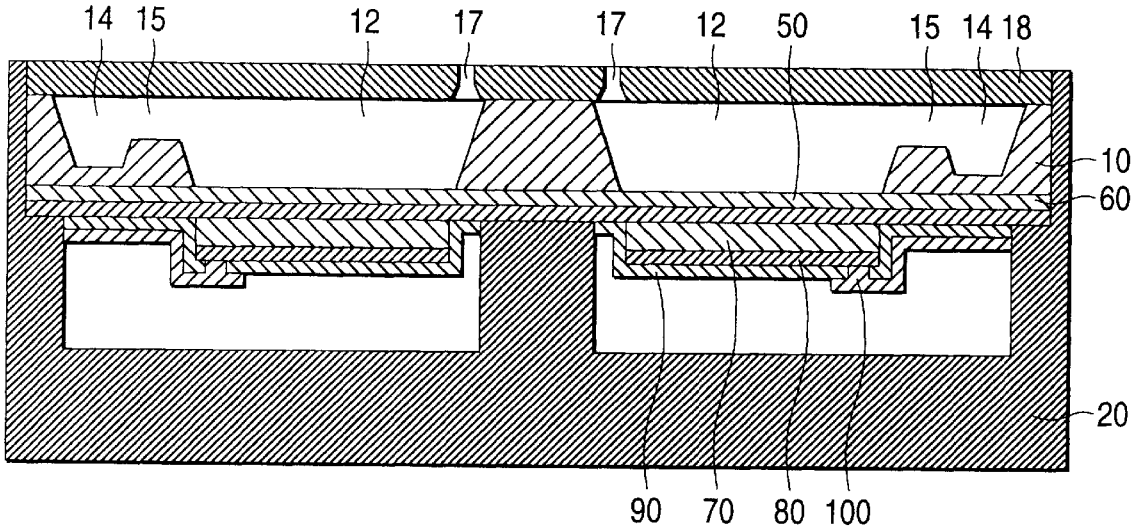
FIGS. 2A and 2B are sectional views showing an ink-jet printing head according to a first embodiment of the present invention.
Figure 2B:
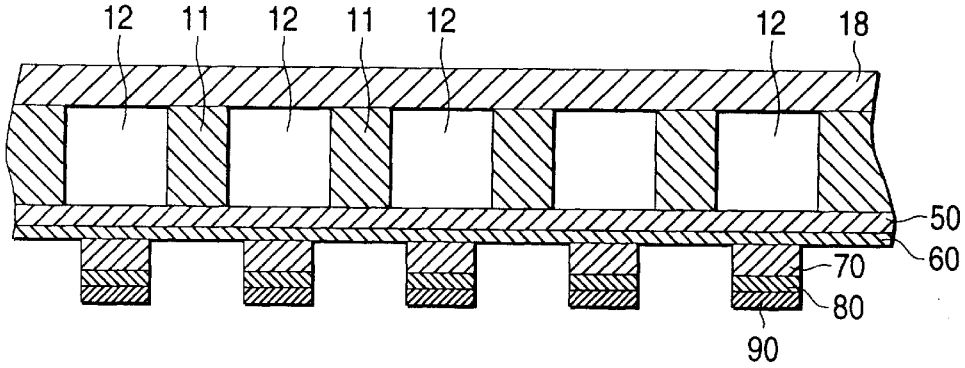

FIG. 1 is an exploded perspective view showing an ink-jet printing head equivalent to an embodiment of the present invention and FIGS. 2A and 2B respectively show sectional structure in the longitudinal direction of one pressure generating chamber and in a cross direction.

As shown in FIGS. 2A and 2B, a passage forming substrate 10 is composed of a monocrystalline silicon substrate with the face orientation of (110) in this embodiment. For the passage forming substrate 10, a thickness of 150 to 300 $\mu$m is normally used. A thickness of 180 to 280 $\mu$m is preferable , and a thickness of approximately 220 $\mu$m is suitable. These thicknesses because arrangement density can be enhanced keeping the rigidity of a partition wall between adjacent pressure generating chambers.

One surface of the passage forming substrate 10 is open and an elastic film 50 with the thickness of 0.1 to 2 $\mu$m and composed of a silicon dioxide film formed by thermal oxidation beforehand is formed on the other surface.

In the meantime, two rows 13 of pressure generating chambers 12 each of which is partitioned by plural partition walls 11, a reservoir 14 arranged approximately in the shape of a letter C so that the reservoir surrounds the three directions of the two rows of pressure generating chambers 12 and ink supply ports 15 each of which connects each pressure generating chamber 12 and the reservoir 14 at fixed flow resistance are formed on the open surface of the passage forming substrate 10 by anisotropically etching the monocrystalline silicon substrate. An ink inlet 16 for supplying ink from the outside to the reservoir 14 is formed approximately in the center of the reservoir 14.

For the above anisotropic etching, when the monocrystalline silicon substrate is dipped in alkaline solution such as KOH, it is gradually eroded, a first face (111) perpendicular to the face (110) and a second face (111) at approximately 70° with the first face (111) and at approximately 35° with the above face (110) emerge, and anisotropic etching is performed utilizing a property that the etching rate of the face (111) is approximately 1/180, compared with the etching rate of the face (110). Precise processing based upon processing in depth in a parallelogram formed by two first faces (111) and two diagonal second faces (111) is enabled by the above anisotropic etching and pressure generating chambers 12 can be arranged in high density.

In this embodiment, the longer side of each pressure generating chamber 12 is formed by the first face (111) and the shorter side is formed by the second face (111). The pressure generating chamber 12 is formed by etching the passage forming substrate 10 approximately throughout up to the elastic film 50. The quantity in which the elastic film 50 is dipped in alkaline solution for etching the monocrystalline silicon substrate is extremely small. Each ink supply port 15 communicating with one end of each pressure generating chamber 12 is formed so that each ink supply port is shallower than each pressure generating chamber. That is, the ink supply port 15 is formed by etching the monocrystalline silicon substrate halfway in the direction of the thickness (half-etching). Half-etching is executed by adjusting etching time.

A reference hole 30 for positioning the passage forming substrate 10 is formed at two diagonal corners of the passage forming substrate 10.

A nozzle plate 18 in which nozzle apertures 17 each of which communicates with the ink supply port 15 of each pressure generating chamber 12 are made is fixed on the open surface of the passage forming substrate 10 via an adhesive, a film welded by heat or others. The nozzle plate 18 is made of glass ceramics or stainless steel 0.1 to 1 mm thick for example, 300° C. or less in a coefficient of linear thermal expansion and 2.5 to 4.5 [$\times 10^{-6}$/°C.] for example. One surface of the nozzle plate 18 covers one surface of the passage forming substrate 10 overall and also functions as a reinforcing plate for protecting the monocrystalline silicon substrate from impact and external force. A reference hole 19 is formed in a position corresponding to the reference hole 30 of the passage forming substrate 10 in the nozzle plate 18.

The size of each pressure generating chamber 12 which applies ink droplet ejecting pressure to ink and the size of each nozzle aperture 17 for ejecting an ink droplet are optimized according to the quantity of ejected ink droplets, ejecting speed and a ejecting frequency. For example, if 360 pieces of ink droplets are recorded per inch, each nozzle aperture 17 is required to be formed precisely so that it has the diameter of a few tens $\mu$m.

In the meantime, a lower electrode 60 approximately 0.5 $\mu$m thick for example, a piezoelectric film 70 approximately 1 $\mu$m thick for example and an upper electrode 80 approximately 0.1 $\mu$m thick for example are laminated on the elastic film 50 on the reverse side to the open surface of the passage forming substrate 10 in a process described later and constitute a piezoelectric element 300. The piezoelectric element 300 means a part including the lower electrode 60, the piezoelectric film 70 and the upper electrode 80. Generally, either electrode of the piezoelectric element 300 functions as a common electrode, and the other electrode and the piezoelectric film 70 are constituted by patterning every pressure generating chamber 12. A part composed of either electrode and the piezoelectric film 70 respectively patterned in which piezoelectric distortion is caused by applying voltage to both electrodes is called a piezoelectric active part 320. In this embodiment, the lower electrode 60 functions as a common electrode of the piezoelectric element 300 and the upper electrode 80 functions as an individual electrode of the piezoelectric element 300, however, even if they are reverse for the convenience of a driving circuit and wiring, there is no problem. In any case, a piezoelectric active part is formed every pressure generating chamber. The piezoelectric element 300 and a diaphragm displaced by driving the piezoelectric element 300 are called a piezoelectric actuator in total. In the above example, the elastic film 50 and the lower electrode 60 function as the diaphragm, however, the lower electrode may also function as the elastic film.

Such passage forming substrate 10 and nozzle plate 18 are fixed to a fixing member 20 provided with a concave portion for holding them. A reference hole 20*a* is also formed in a position corresponding to the reference hole 30 of the passage forming substrate 10 in the fixing member 20.

Referring to FIG. 3 and FIG. 4, a process in which the piezoelectric film 70 and others are formed on the passage forming substrate 10 composed of the monocrystalline silicon substrate will be described below.

Figure 3A:
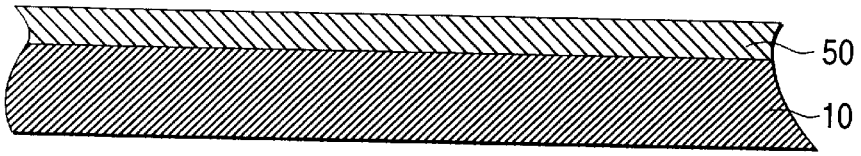
FIGS. 3A to 3E are sectional views showing a thin film manufacturing process in the first embodiment of the present invention.

As shown in FIG. 3A, first, a wafer of a monocrystalline silicon substrate to be the passage forming substrate 10 is thermally oxidized in a diffusion furnace approximately at 1100° C. and the elastic film 50 made of silicon dioxide is formed.

Figure 3B:
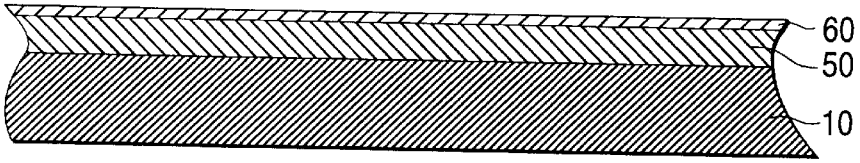

Next, as shown in FIG. 3B, the lower electrode 60 is formed by sputtering. For the material of the lower electrode 60, platinum (Pt) and others are suitable. The reason is that the piezoelectric film 70 described later formed by sputtering and sol-gel transformation is required to be burned and crystallized at approximately 600 to 1000° C. in atmosphere or in the atmosphere of oxygen after the film is formed. That is, the material of the lower electrode 60 is required to keep conductivity at such high temperature in the atmosphere of oxygen, particularly if lead zirconate titanate (PZT) is used for the material of the piezoelectric film 70, it is desirable that conductivity is hardly varied by the diffusion of PbO and for the above reasons, Pt is suitable.

Figure 3C:
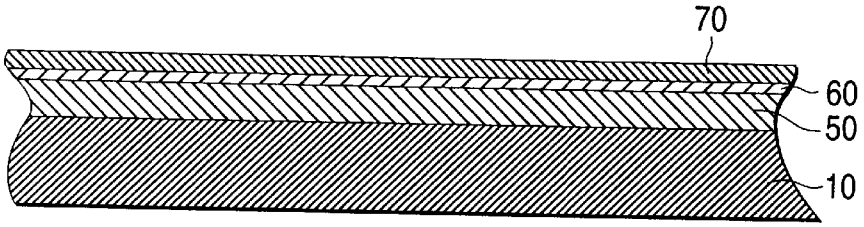

Next, as shown in FIG. 3C, the piezoelectric film 70 is formed. The piezoelectric film can be also formed by sputtering, however, in this embodiment, so-called sol-gel transformation in which the piezoelectric film 70 composed of metallic oxide is obtained by applying, drying, gelling so-called sol in which a metallic organic substance is dissolved and dispersed in a solvent and further, burning it at high temperature is used. For the material of the piezoelectric film 70, material such as PZT is suitable in case it is used for an ink-jet printing head.

Figure 3D:
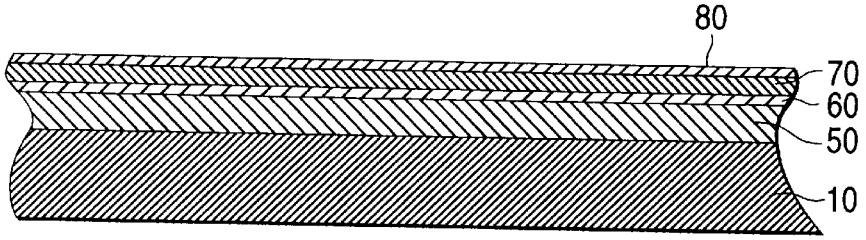

Next, as shown in FIG. 3D, the upper electrode film 80 is formed. The upper electrode film 80 has only to be formed by material high in conductivity, and many metals such as Al, Au, Ni and Pt, conductive oxide and others may be used. In this embodiment, Pt is used.

Figure 3E:
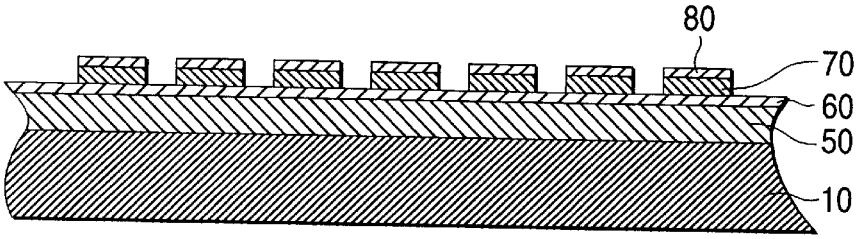

Next, as shown in FIG. 3E, the upper electrode film 80 and the piezoelectric film 70 are patterned so that each piezoelectric element is arranged opposite to each pressure generating chamber 12. FIG. 3E shows a case that the piezoelectric film 70 is patterned using the same pattern as the upper electrode film 80, however, as described above, the piezoelectric film 70 is not necessarily required to be patterned. This is because if voltage is applied with the upper electrode film 80 patterned as an individual electrode, an electric field is applied only between each upper electrode film 80 and the lower electrode film 60 which is a common electrode and has no effect upon the other part. However, in this case, as large voltage is required to be applied to obtain the same excluded volume, it is desirable that the piezoelectric film 70 is also patterned. Afterward, the lower electrode film 60 is patterned and an unnecessary part is removed.

The above patterning is executed by etching after a resist pattern is formed.

The above resist pattern is formed by applying negative resist by spinning, exposing using a mask in a predetermined shape, developing and baking. Needless to say, positive resist may be also used in place of negative resist.

Etching is executed using a dry etching device such as an ion milling machine until the elastic film 50 made of silicon dioxide is exposed. After etching, a resist pattern is removed using an ashing device and others.

For a dry etching method, a reactive etching method and others may be also used in addition to an ion milling method. Wet etching may be also executed in place of dry etching, however, as patterning precision is slightly inferior to that of dry etching and the material of the upper electrode film 80 is also limited, it is desirable that dry etching is executed.

Figure 4A:
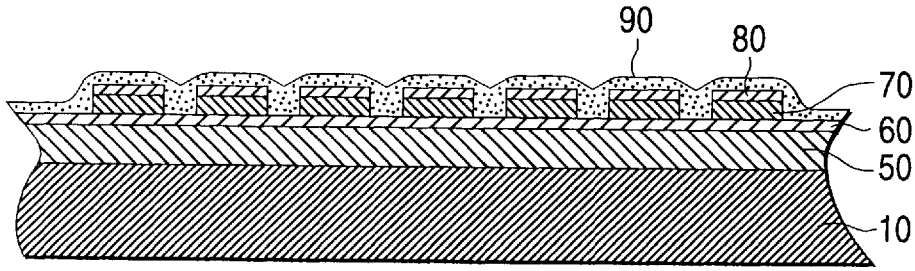
FIGS. 4A to 4C are sectional views showing the thin film manufacturing process in the first embodiment of the present invention.

Next, as shown in FIG. 4A, an insulating layer 90 is formed so that the periphery of the upper electrode film 80 and the side of the piezoelectric film 70 are covered. For the material of the insulating layer 90, in this embodiment, negative photosensitive polyimide is used.

Figure 4B:
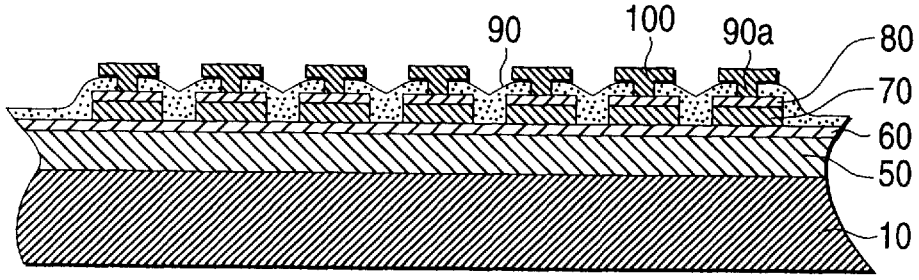

Next, as shown in FIG. 4B, a contact hole 90*a* is formed in a part opposite to each communicating part 14 by patterning the insulating layer 90. The contact hole 90*a* is provided to connect a lead electrode 100 described later and the upper electrode film 80.

Next, the lead electrode 100 is formed by patterning after an electric conductor such as Cr-Au is formed overall.

Figure 4C:
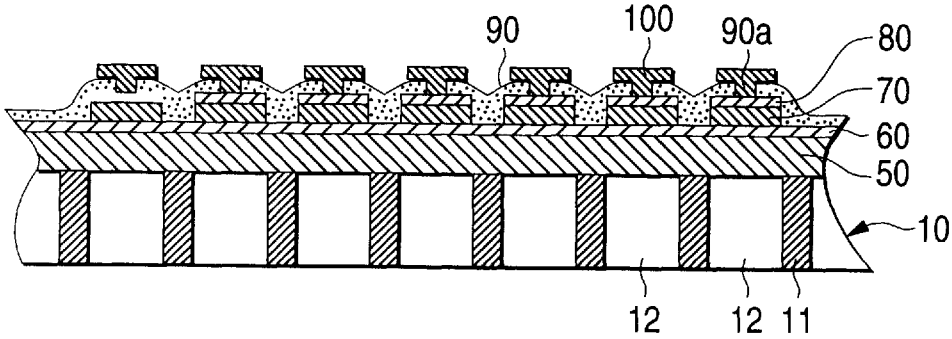

The film forming process is described above. After the films are formed as described above, the monocrystalline silicon substrate is anisotropically etched in the above alkaline solution as shown in FIG. 4C, and pressure generating chambers 12 are others are formed. In the above series of film forming and anisotropic etching, multiple chips are simultaneously formed on one wafer and after the process is finished, the one wafer is divided every passage forming substrate 10 in one chip size as shown in FIG. 1.

The above ink inlet 16, the reference hole 30 and a through hole such as a separating hole formed between chips to separate into each chip are simultaneously formed together with the pressure generating chamber 12 by anisotropic etching processing, however, in this embodiment, piercing work after etching can be simply and securely executed by providing a notched groove lower in fragility than the other part in a part corresponding to a through hole of a multilayer film in a process described later.

For example, a notched part 41 in a predetermined shape is formed in the above film forming process together in the multilayer film 40 covering a part corresponding to the reference hole 30 and a part covering the reference hole 30.

Figure 5A:
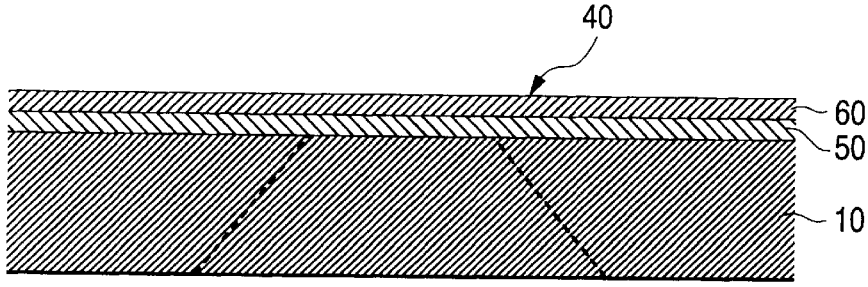
FIGS. 5A to 5D are sectional views showing a main part reference hole forming process in the first embodiment of the present invention.

That is, as shown in FIG. 5A, first, the multilayer film 40 is formed on the passage forming substrate 10. For the multilayer film 40, in this embodiment, the lower layer is the elastic film 50 provided with compressive in-plane stress and made of silicon oxide and others for example and the upper layer is the lower electrode film 60 provided with tensile in-plane stress and made of platinum and others for example. At this time, the multilayer film 40 is formed so that it has tensile stress as a whole.

Figure 5B:
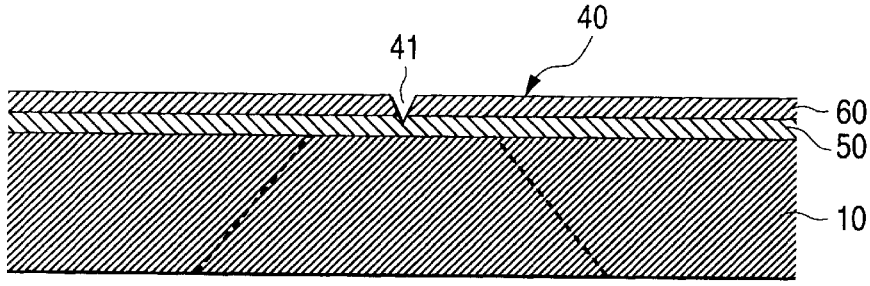
Figure 6A:
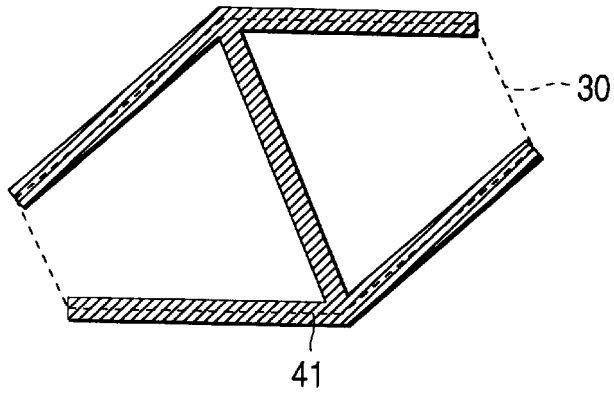
FIGS. 6A and 6B are plans showing a main part in the first embodiment of the present invention.
Figure 6B:
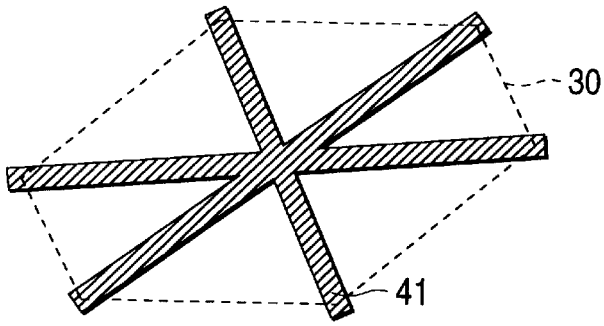

Next, as shown in FIG. 5B, the notched part 41 in a predetermined shape is formed by etching and others. The notched part 41 is formed approximately in the shape of a letter H as a whole on four sides except two sides opposite to each other of the approximately hexagonal reference hole 30 and one diagonal connecting them as shown in FIG. 6A in this embodiment. The pattern of the notched part 41 is not particularly limited and for example, as shown in FIG. 6B, the notched part may be also formed on three diagonals of the approximately hexagonal reference hole 30. That is, the above pattern is a pattern that if the multilayer film is cut along the notched part 41, a part of the multilayer film 40 is not cut and if the multilayer film 40 is lifted along the cutting plane line, the edge with which a reference pin and others are in contact is completely exposed.

The size of the notched part 41 is not particularly limited, however, it is desirable that the notched part is formed up to at least a part in the direction of the thickness of the lower electrode film 60. The shape of the notched part 41 is also not particularly limited and in this embodiment, the notched part is a groove the section of which is approximately V type, however, for example, the notched part may be also a concave groove the section of which is semicircular or rectangular.

Figure 5C:
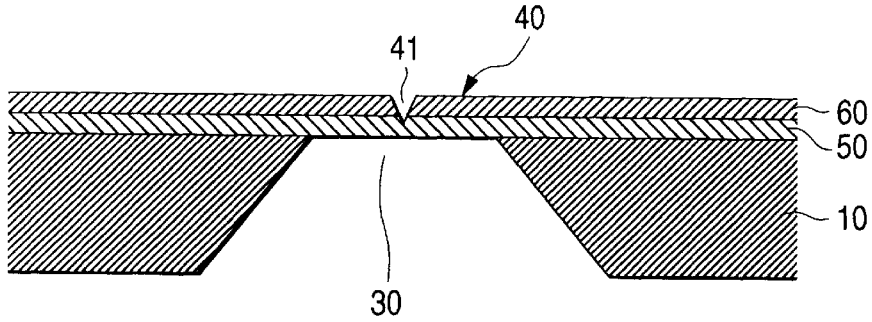
Figure 5D:
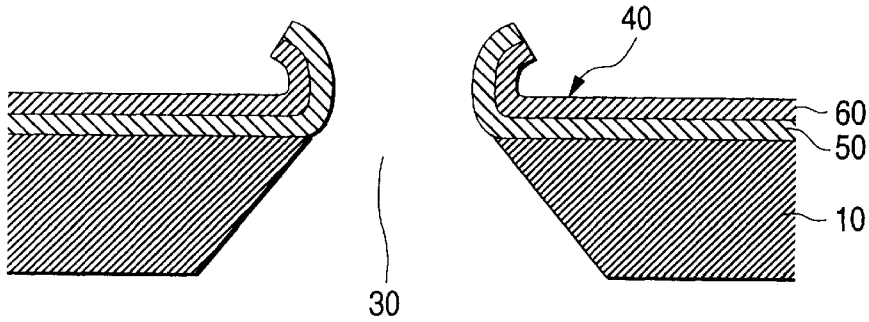

Next, the reference hole 30 is made open by etching the reference hole 30 in this state as shown in FIG. 5C and piercing a part corresponding to the reference hole 30 of the multilayer film 40 as shown in FIG. 5D.

The process for piercing the multilayer film 40 is executed by mechanically pressing the multilayer film from the side of the reference hole 30, cutting apart of the notched part 41 by radiating a laser beam and others or pressing the multilayer film from the side of the reference hole 30 after a part of the notched part 41 is cut for example utilizing that the multilayer film 40 is lifted upward by the internal tensile stress.

Figure 7:
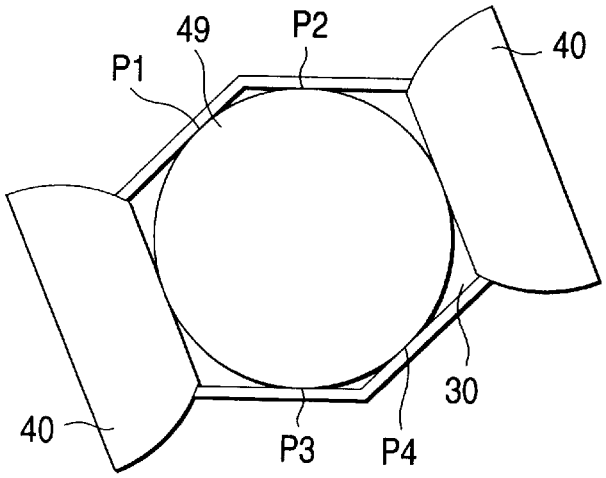
FIG. 7 is a plan showing the main part in the first embodiment of the present invention.

In such piercing work, as the multilayer film 40 is provided at least in a part with a part in which the notched part 41 is not formed as described above, a cut piece is never scattered. As the multilayer film 40 is securely lifted along an edge line with which a reference pin 49 and others are in contact as shown in FIG. 7 when the reference pin 49 and others are fitted into the reference hole 30, the multilayer film 40 is never put in parts P1 to P4 in which the reference pin 49 and others and the edge are in contact, and the reference pin 49 and others can be securely fitted.

The reference hole 30 is described above, however, the similar action may be also taken for other through holes such as the ink inlet 16.

In the ink-jet printing head constituted as described above, pressure in the pressure generating chamber 12 is increased and an ink droplet is ejected from the nozzle aperture 17 by applying voltage between the lower electrode film 60 and the upper electrode film 80 via the lead electrode 100 according to a recording signal from an external driving circuit not shown and deforming the elastic film 50 and the piezoelectric film 60 so that they are flexuous after ink is fetched from the ink inlet 16 connected to external ink supply means not shown and the inside from the reservoir 14 to the nozzle aperture 17 is filled with ink.

2. Second Embodiment

Figure 8:
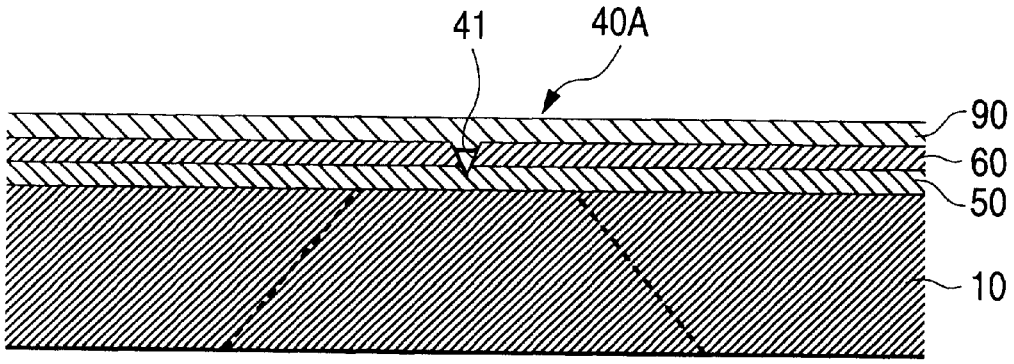
FIG. 8 is a sectional view showing a main part in a second embodiment of the present invention.

FIG. 8 shows the section of the main part of an ink-jet printing head equivalent to a second embodiment.

This embodiment is the same as the above embodiment except that an insulating layer is further formed on a lower electrode film 60.

That is, also in this embodiment, as in the above embodiment, first, an elastic film 50 provided with compressive stress and a lower electrode film 60 provided with tensile stress are formed and a notched part 41 in a predetermined shape is formed in a part covering a reference hole 30 of a passage forming plate 10 by etching and others.

Next, as shown in FIG. 8, an insulating layer 90 is formed on the lower electrode film 60 and a multilayer film 40A is composed of the elastic film 50, the lower electrode film 60 and the insulating layer 90. At this time, as the insulating layer 90 is formed along the shape of the notched part 41 in a part opposite to the notched part 41, the notched part 41 is maintained.

The insulating layer 90 is formed by material provided with tensile stress such as polyimide. At this time, also in this embodiment as in the above embodiment, the multilayer film 40A is required to be provided with tensile stress as a whole.

In this embodiment, the insulating layer 90 is formed after the notched part 41 is formed, however, after the insulating layer 90 is formed on the lower electrode film 60, a notched part may be also formed overall.

Afterward, as in the above embodiment, the reference hole 30 is etched, a part corresponding to the reference hole 30 of the multilayer film 40A is pierced and the reference hole 30 is made open.

Hereby, as the multilayer film 40A is provided with further strong tensile stress as a whole, the multilayer film 40A is securely lifted in work for piercing the reference hole 30.

The multilayer film has only to be provided with tensile stress as a whole as in the above embodiment and for example, the piezoelectric film 70 and the upper electrode film 80 may be also formed on the lower electrode film 60. In this case, for the notched part 41, at least a part of the lower electrode film 60 in the direction of the thickness has only to be notched and for example, after the notched part 41 is formed, a film may be also formed on the lower electrode film 60 and after a film is formed, a notched part up to the lower electrode film 60 may be also formed.

3. Third Embodiment

Figure 9:
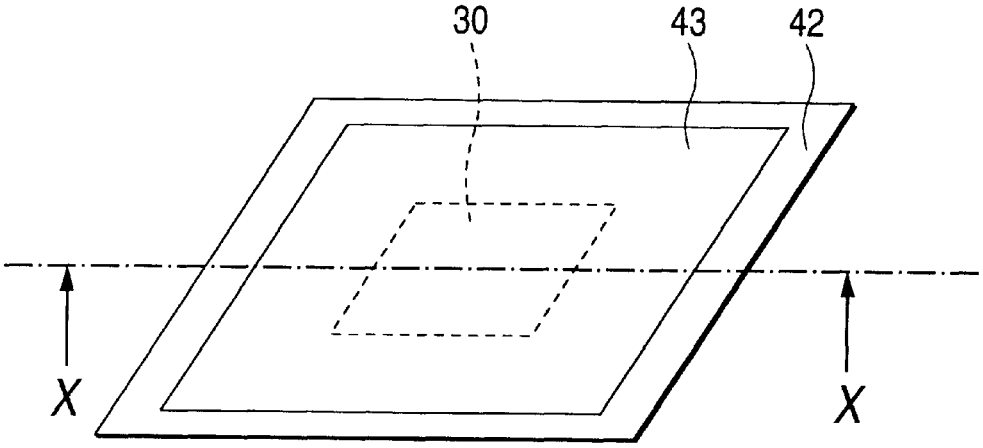
FIG. 9 is a plan showing a main part in a third embodiment of the present invention.

FIG. 9 is a plan showing the main part of an ink-jet printing head equivalent to a third embodiment and FIGS. 10 are sectional views viewed along a line X—X in FIG. 9.

In this embodiment, a thin film part 42 surrounding a reference hole 30 and thinner as a whole than the other part and a cap 43 thicker as a whole than the thin film part and covering a part corresponding to the reference hole 30 are provided in place of forming the notched part 41.

Figure 10A:
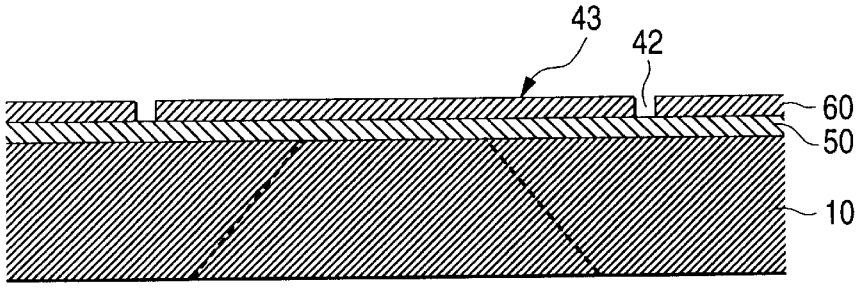
FIGS. 10A through 10C are sectional views viewed along a line X—X' in FIG. 9.
Figure 10B:
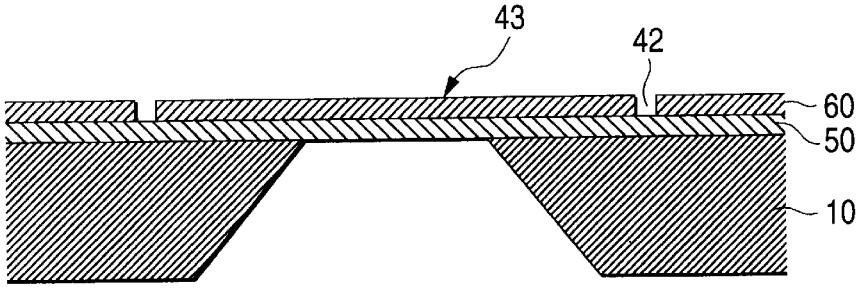
Figure 10C:
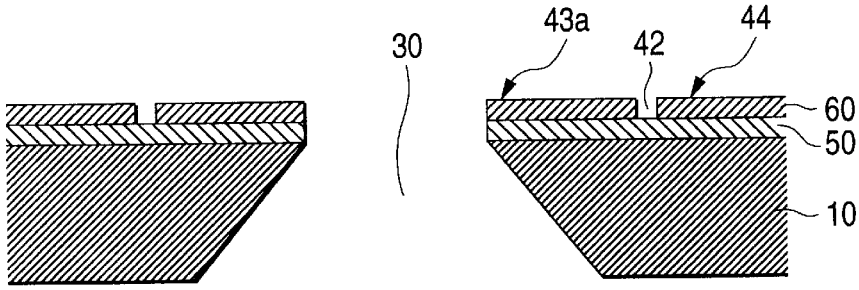

That is, as shown in FIGS. 9 and 10A, the cap 43 covering the part corresponding to the reference hole 30 and the linear thin film part 42 surrounding the cap 43 are formed together in the above film forming process and as shown in FIG. 10B, etching is executed in this state. Afterward, as shown in FIG. 10C, the reference hole 30 is formed by removing a part corresponding to the reference hole 30 of the cap 43. At this time, in this embodiment, a thick film part 43*a* is left between the thin film part 42 and the reference hole 30. This is because a film in a part opposite to the reference hole 30 is ideally removed and there is also a case that a film removed part is formed around the reference hole 30 depending upon a state in which the film is removed.

In this example, the cap 43 is equivalent to an elastic film 50 and a lower electrode film 60 and the thin film part 42 is equivalent to only the elastic film 50. Therefore, even if the elastic film 50 has a defect, etching gas or etchant never invades the reverse side in etching.

A process for removing the cap 43 can be executed by physical means such as mechanically boring using a needle and others and radiating a laser beam. It is desirable that the removing process is executed, removing the remains of the cap 43 by attraction.

In such removing work, as the thin film part 42 exists around the cap 43, only the cap 43 can be readily removed and afterward, in a mounting process and others for example, a thick film part 44 around the thin film part 42 is never peeled.

At least the outer edge of the thin film part 42 has only to be located outside the outer edge of the opening of the reference hole 30. Therefore, the inner edge of the thin film part 42 may be also located in a position opposite to the reference hole 30 and in this case, if a film covering the reference hole 30 is removed, the thin film part 42 exists around it.

The process for removing the cap 43 may be also executed by etching. At this time, the existence of the thin film part 42 can prevent a film from being peeled due to overetching and only the cap 43 can be securely removed.

The reference hole 30 is described above, however, the similar action may be also taken for the other through holes such as an ink inlet 16.

Figure 11:
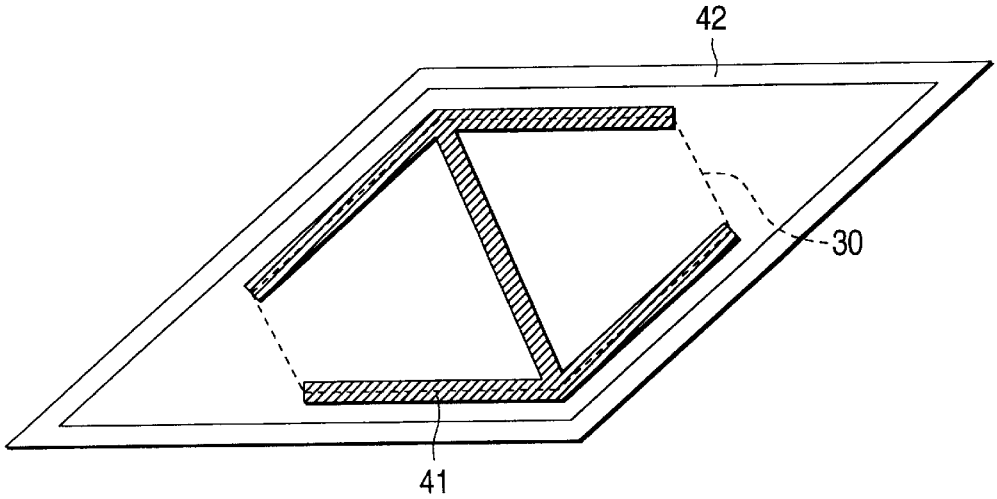
FIG. 11 is a plan showing another example in the third embodiment of the present invention.

In this embodiment, the thin film part 42 and the cap 43 are provided in place of the above notched part 41, however, the present invention is not limited to this and needless to say, a combination of them may be also provided. For example, as shown in FIG. 11, the thin film part 42 may be also provided around the reference hole 30 outside a notched part 41 and the notched part 41 may be also provided on the cap 43. In such constitution, the lifted multilayer film 40 is never peeled outside the thin film part 42 owing to the notched part 41 and the multilayer film can be prevented from being peeled more than required.

4. Fourth Embodiment

FIG. 12 respectively show the section of the main part of an ink-jet printing head equivalent to a fourth embodiment.

This embodiment is the same as the third embodiment except that the structure of a cap and a thin film part is varied.

In this embodiment, as shown in FIG. 12, a cap 43A is formed by an elastic film 50, a lower electrode film 60, a piezoelectric film 70 and an upper electrode film 80 and a thin film part 42A is formed by the elastic film 50 and the lower electrode film 60.

Figure 12A:
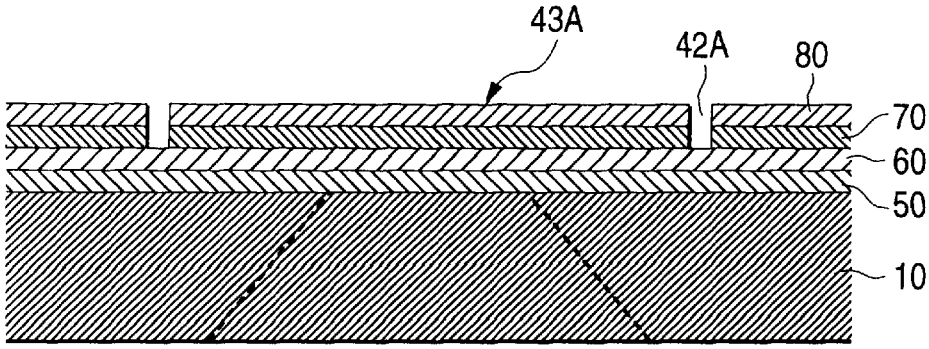
FIGS. 12A to 12C are sectional views showing a main part in a fourth embodiment of the present invention.
Figure 12B:
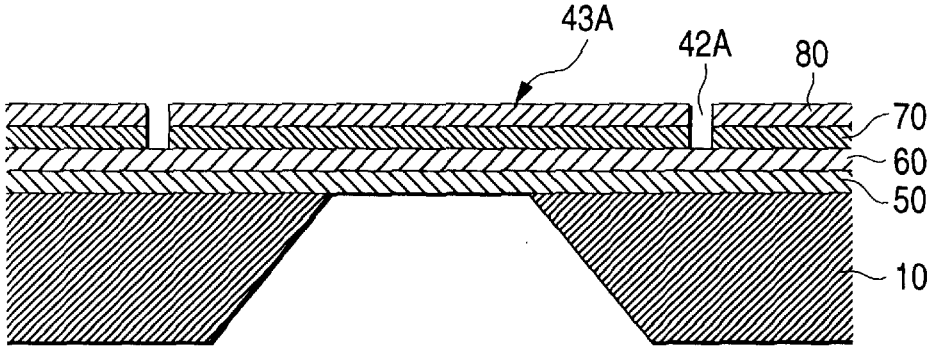

Therefore, leakage due to the defect of a film in etching can be securely avoided as shown in FIGS. 12A and 12B. As the linear thin film part 42A exists around the cap 43A, only the cap 43A can be simply and securely removed when it is removed and the peeling of a film has no effect upon a thick film part 44A around the cap.

Figure 12C:
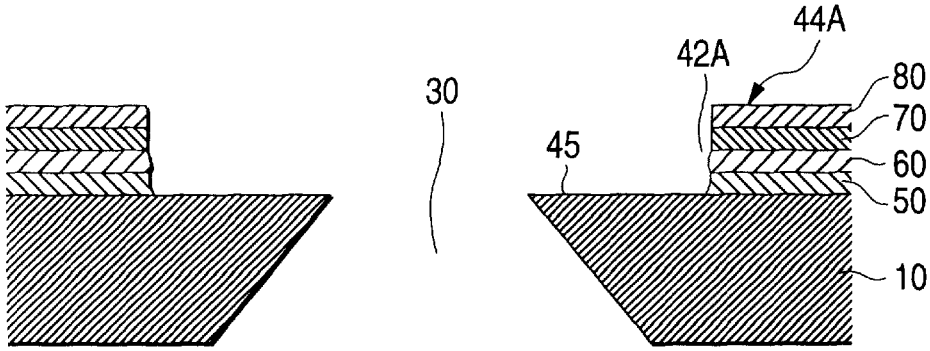

FIG. 12C shows a state in which the whole cap 43A is removed by mechanical working, after the cap 43A is removed, a film removed part 43 exists around the reference hole 30 and the thin film part 42A is formed around the film removed part.

The cap 41A may be also removed by etching and as the thin film part 42A is also left by etching, a film can be prevented from being peeled due to overetching.

5. Fifth Embodiment

Figure 13A:
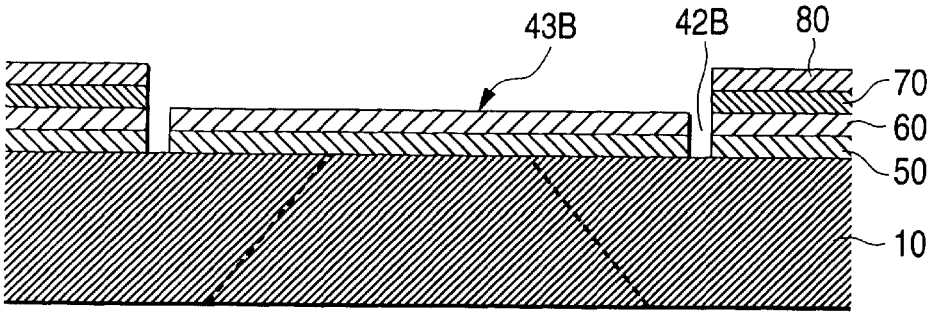
FIGS. 13A to 13C are sectional views showing a main part in a fifth embodiment of the present invention.
Figure 13B:
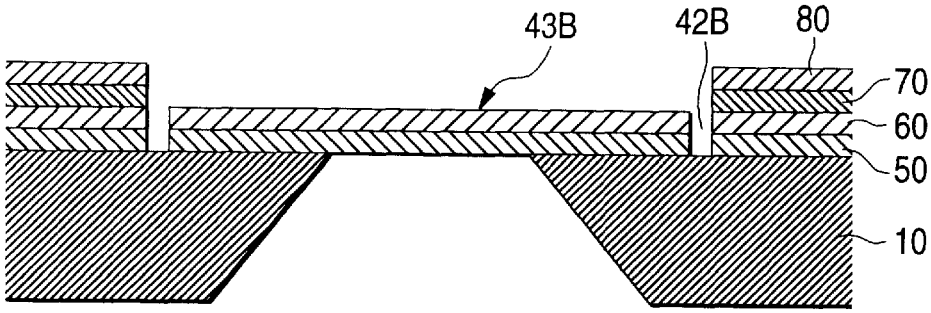
Figure 13C:
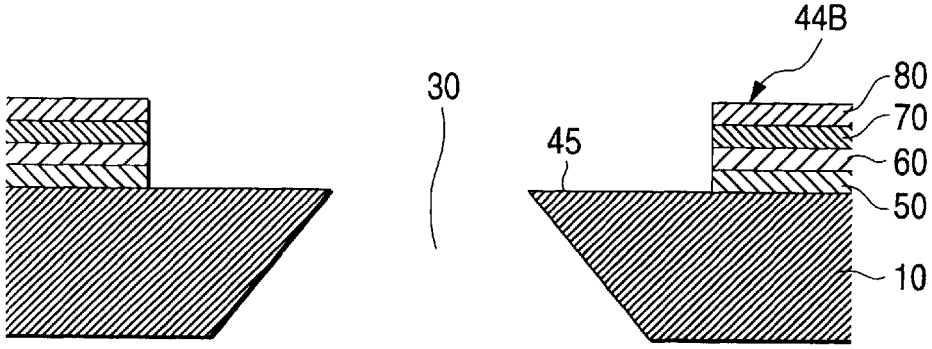

FIG. 13 respectively show the section of the main part of an ink-jet printing head equivalent to a fifth embodiment.

This embodiment is the same as the third embodiment except that the structure of a cap and a thin film part is varied.

In this embodiment, as shown in FIG. 13, a cap 43B is formed by an elastic film 50 and a lower electrode film 60 and a thin film part 42B is a film removed part in which all films are removed.

In this case, leakage in etching can be securely prevented owing to the cap 43B. As the linear thin film part 42B is formed around the cap 43B, the cap 43B can be simply and securely removed and the peeling of a film has no effect upon a thick film part 44B around the cap.

The cap 43B may be removed physically or by etching.

6. Sixth Embodiment

Figure 14A:
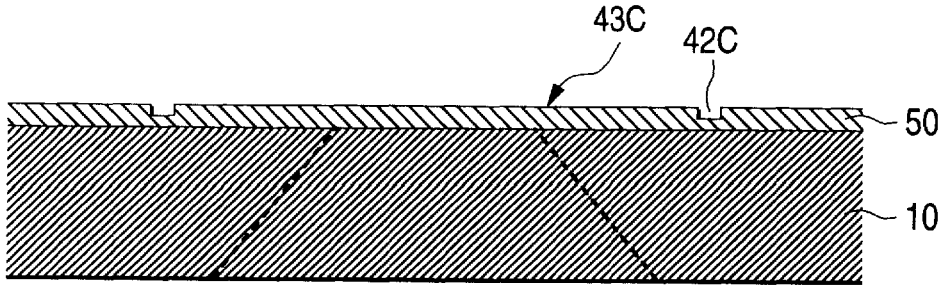
FIGS. 14A to 14C are sectional views showing a main part in a sixth embodiment of the present invention.
Figure 14B:
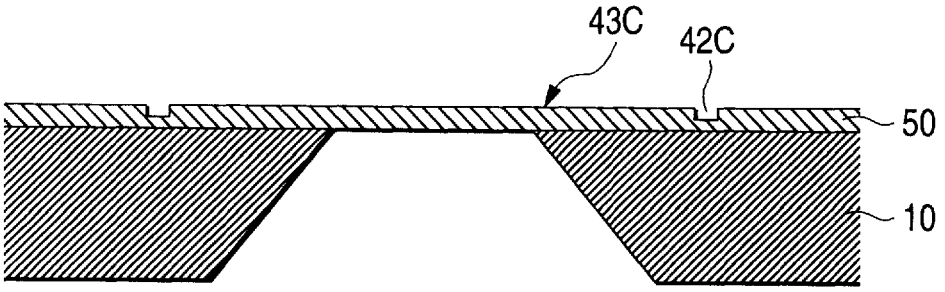

FIG. 14 respectively show the section of the main part of an ink-jet printing head equivalent to a sixth embodiment.

This embodiment is the same as the third embodiment except that the structure of a cap and a thin film part is varied.

In this embodiment, as shown in FIG. 14, a cap 43C is formed by only an elastic film 50 and a part of the thickness of the elastic film 50 is removed in a thin film part 42C.

In this case, the elastic film 50 is formed, controlling stress so that no film defect is made and if necessary, is formed so that the elastic film is thick. In this case, as the linear thin film part 42C is formed around the cap 43C, the cap 43C can be simply and securely removed and an effect of the peeling of a film and others upon a thick film part 44C around the cap can be securely avoided.

The cap 43C may be removed physically or by etching.

Figure 14C:
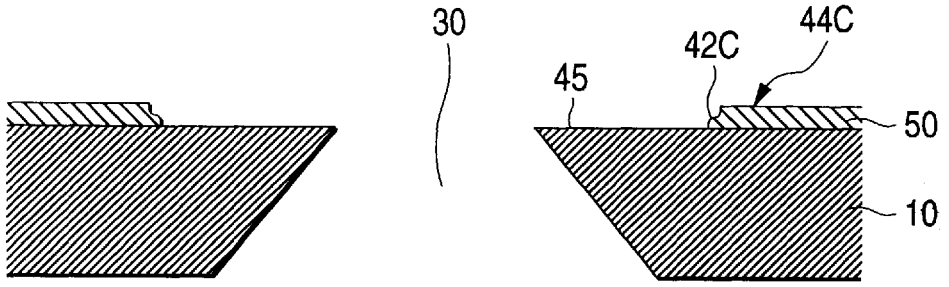

FIG. 14C shows a state in which the cap 43C is removed by mechanical working, however, as the thin film part 42C is also left by etching, only the cap 43C can be removed without overetching.

Further, the thin film part 42C may be also a film removed part in which the whole elastic film 50 is removed.

Other embodiments

The embodiments of the present invention are described above, however, the basic constitution of the ink-jet printing head is not limited to the above.

For example, in the above embodiments, the reservoir 14 is formed together with the pressure generating chambers 12 in the passage forming substrate 10, however, a member forming a common ink chamber may be also provided on the passage forming substrate 10.

Further, in the above embodiments, a connection of the upper electrode film and the lead electrode may be also provided in any location, at any end of the pressure generating chamber or in the center.

In the above embodiments, the case that the insulating layer is provided between the piezoelectric element and the lead electrode is described, however, the present invention is not limited to the case, for example, an anisotropic conductive film may be also thermally welded to each upper electrode without providing the insulating layer, the anisotropic conductive film may be also connected to the lead electrode and in addition, connection may be also made using various bonding technique such as wire bonding.

As described above, the present invention can be applied to a micro device such as a micro sensor in addition to ink-jet printing heads provided with various structures unless they violate the object.

Figure 15:
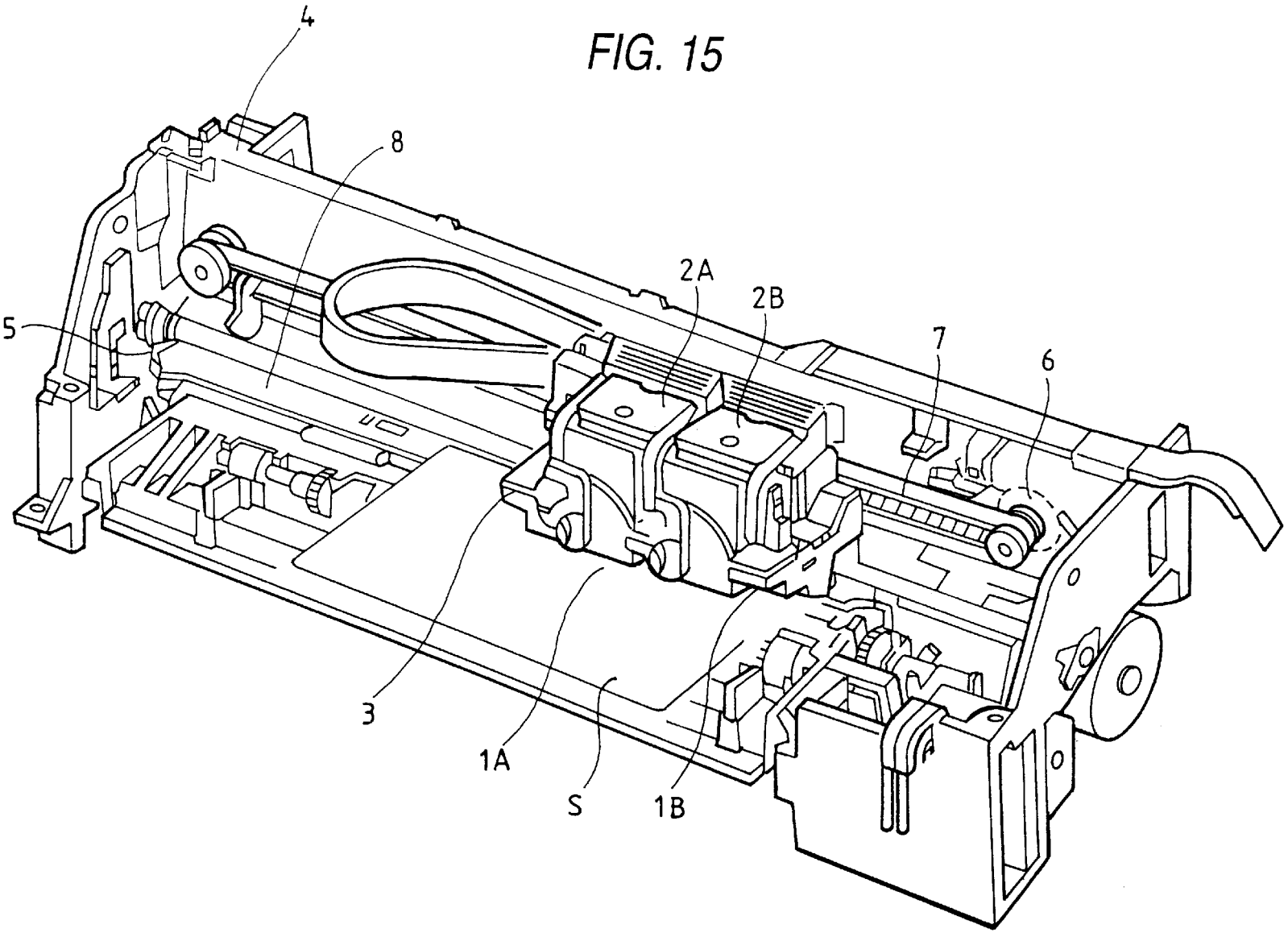
FIG. 15 is a perspective view schematically showing a ink-jet recording device equivalent to an embodiment of the present invention.

The ink-jet printing head equivalent to the above each embodiment constitutes a part of a printing head unit provided with an ink passage communicating with an ink cartridge and others and is mounted in an ink-jet recording device. FIG. 15 schematically shows an example of such an ink-jet recording device.

As shown in FIG. 15, cartridges 2A and 2B constituting ink supply means are respectively provided to printing head units 1A and 1B respectively provided with an ink-jet printing head so that the cartridges can be detached and a carriage 3 mounting the printing head units 1A and 1B is provided to a carriage shaft 5 attached to the body 4 of the device so that the carriage can be moved in the direction of the shaft. The purpose of the printing head units 1A and 1B is respectively to eject a black ink composition and a color ink composition for example.

The carriage 3 mounting the printing head units 1A and 1B is moved along the carriage shaft 5 by transmitting driving force of a driving motor 6 to the carriage 3 via plural gears not shown and a timing belt 7. In the meantime, a platen 8 is provided along the carriage 3 to the body 4 of the device. The device is constituted so that the platen 8 can be rotated by the driving force of a paper feed motor not shown, a recording sheet S which is a recording medium such as paper supplied by a paper feed roller and others is wound on the platen 8 and carried.

As described above, according to the present invention, effect that a multilayer film provided with tensile stress inside as a whole is formed as a part for covering a through hole, the multilayer film after etching can be readily and securely pierced by providing a notched part when the through hole is formed in a substrate by etching, a film is prevented from being scattered and a reference pin and others can be precisely fitted into the through hole is produced.

As described above, according to the present invention, effect that as a cap and a thin film part around the cap are provided, leakage in etching can be prevented when a through hole is formed in a substrate by etching and the cap can be simply and securely removed after etching is produced.

What is claimed is:

1. A micro device comprising:

a substrate;

multilayer film comprising an active plate and an active plate actuator for driving said active plate on one side of said substrate;

a through hole piercing said substrate; and a fragile part disposed on said multilayer film around or across a part corresponding to said through hole, said fragile part being thinner than other parts of said multilayer film so that said through hole will pass through said multilayer film.

2. A micro device according to claim 1, wherein:

said multilayer film covering the part corresponding to said through hole comprises at least a film having tensile in-plane stress as an upper layer so that the in-plane stress of the whole multilayer film is tensile stress; and said fragile part is disposed on said multilayer film around or across an area corresponding to said through hole and including a fragile cut part lower in fragility than the other parts.

3. A micro device according to claim 2, wherein said fragile cut part is formed linearly.

4. A micro device according to claim 3, wherein said fragile cut part is a notched groove formed at least in one layer of said multilayer film.

5. A micro device according to claim 2, wherein said fragile cut part is a notched groove formed at least in one layer of said multilayer film.

6. A micro device according to claim 5, wherein said notched groove is H-shaped.

7. A micro device according to claim 5, wherein said notched groove comprises diagonals extending across a polygon.

8. A micro device according to any of claims 2, 3, 5 or 4, wherein said multilayer film comprises a silicon oxide film having compressive stress and a metallic film formed on the silicon oxide film and having tensile stress.

9. A micro device according to claim 8, wherein said multilayer film is further provided with an insulating layer having tensile stress as an upper layer.

10. A micro device according to claim 9, wherein said fragile cut part is a notched groove formed at least in a part at least with the thickness of the metallic film of said multilayer film.

11. A micro device according to claim 8, wherein said fragile cut part is a notched groove formed at least in a part at least with the thickness of the metallic film of said multilayer film.

12. A micro device according to claim 8, wherein said fragile part comprises a linear film part surrounding the part corresponding to said through hole and thinner as a whole than the surroundings of said multilayer film.

13. An ink-jet printing head including the micro device according to claim 8, wherein said substrate in said micro device is provided with pressure generating chambers each of which communicates with a nozzle aperture, a multilayer structure is formed on one side of said substrate in an area opposite to said pressure generating chamber, the multilayer structure is composed of a vibration plate as said active plate and a piezoelectric element as said active plate actuator, the vibration plate includes an elastic film and/or a lower electrode, and the piezoelectric element includes an upper electrode, a piezoelectric layer and a lower electrode.

14. A micro device according to any of claims 1, 2, 3, 5, 9 or 4, wherein said fragile part comprises a linear thin film part surrounding the part corresponding to said through hole and thinner as a whole than the surroundings of said multilayer film.

15. A micro device according to claim 14, further comprising a thick film part relatively thicker than said thin film part formed inside said thin film part.

16. An ink-jet printing head including the micro device according to claim 14, wherein said substrate in said micro device is provided with pressure generating chambers each of which communicates with a nozzle aperture, a multilayer structure is formed on one side of said substrate in an area opposite to said pressure generating chamber, the multilayer structure is composed of a vibration plate as said active plate and a piezoelectric element as said active plate actuator, the vibration plate includes an elastic film and/or a lower electrode, and the piezoelectric element includes an upper electrode, a piezoelectric layer and a lower electrode.

17. An ink-jet printing head including the micro device according to any of claims 1, 2, 3, 5, 4, 9, 11, 10, 15, 13 or 16, wherein said substrate in said micro device is provided with pressure generating chambers each of which communicates with a nozzle aperture, a multilayer structure is formed on one side of said substrate in an area opposite to said pressure generating chamber, the multilayer structure is composed of a vibration plate as said active plate and a piezoelectric element as said active plate actuator, the vibration plate includes an elastic film and/or a lower electrode, and the piezoelectric element includes an upper electrode, a piezoelectric layer and a lower electrode.

18. An ink-jet printing head according to claim 17, wherein said fragile part is composed of said vibration plate.

19. An ink-jet printing head according to claim 17, wherein in said fragile part, at least a part in the direction of the thickness of said vibration plate is removed.

20. An ink-jet printing head according to claim 17, wherein said fragile part is composed of said elastic film.

21. An ink-jet printing head according to claim 17, wherein in said fragile part, at least a part in the direction of the thickness of said elastic film is removed.

22. An ink-jet printing apparatus including the ink-jet printing head according to any of claims 18 to 21.

23. An ink-jet printing apparatus including the ink-jet printing head according to claim 17.

24. A micro device comprising:

a substrate;

a multilayer film on said substrate;

a through hole passing through both of said substrate and said multilayer film; and a recessed portion on said multilayer film;

wherein said substrate has been subjected to etching to form a part of said through hole, and said multilayer film has been physically broken to form the rest of said through hole, and wherein an open edge of said through hole is located at one of: on a boundary defined by said recessed portion; and within a boundary defined by said recessed portion.

25. A micro device comprising:

a substrate;

a multilayer film on said substrate defining an active region and an inactive region;

a through hole piercing said substrate at a location within said inactive region;

a recessed portion on said multilayer film around or across a part corresponding to said through hole, said recessed portion being located with said inactive region so that said through hole will pass through said multilayer film.

26. A micro device comprising:

a substrate;

a multilayer film on said substrate defining an active region and an inactive region;

a through hole passing through both said substrate and said multilayer film; and a recessed portion on said multilayer film within said inactive region;

wherein an open edge of said through hole is located at one of: on a boundary defined by said recessed portion; and within a boundary defined by said recessed portion.

* * * * *